US007959018B2

(12) United States Patent
Flickinger

(10) Patent No.: US 7,959,018 B2
(45) Date of Patent: Jun. 14, 2011

(54) SPORTS APPAREL ORAGNIZER

(76) Inventor: Brent D Flickinger, Medina, OH (US)

( * ) Notice: Subject to any disclaimer, the term of this patent is extended or adjusted under 35 U.S.C. 154(b) by 596 days.

(21) Appl. No.: 11/879,427

(22) Filed: Jul. 17, 2007

(65) Prior Publication Data

US 2009/0020490 A1 Jan. 22, 2009

(51) Int. Cl.
*A47G 29/00* (2006.01)

(52) U.S. Cl. ..... 211/85.3; 211/30

(58) Field of Classification Search ..... 211/85.3, 211/87.01, 30–33, 85.11, 13.1, 181.1, 86.01; 206/8, 9; D6/315, 320; 223/7, 12, 24; 248/309.1
See application file for complete search history.

(56) References Cited

U.S. PATENT DOCUMENTS

| | | | | | |
|---|---|---|---|---|---|
| 318,657 | A | * | 5/1885 | Richards | 211/106.01 |
| 366,608 | A | * | 7/1887 | Raymond | 211/32 |
| 394,637 | A | * | 12/1888 | Baker | 223/88 |
| 446,946 | A | * | 2/1891 | Ingal | 211/32 |
| 547,856 | A | * | 10/1895 | Matthies | 211/32 |
| 577,010 | A | * | 2/1897 | Cundey | 211/32 |
| D29,729 | S | * | 11/1898 | Brough | D6/323 |
| 615,918 | A | * | 12/1898 | Smith | 211/96 |
| 623,727 | A | * | 4/1899 | Magill | 211/30 |
| 821,364 | A | * | 5/1906 | Jessel | 211/89.01 |
| 846,956 | A | * | 3/1907 | Shaw | 211/32 |
| 909,114 | A | * | 1/1909 | Pitts | 211/9 |
| 973,090 | A | * | 10/1910 | Weaver | 211/106 |
| 1,091,812 | A | * | 3/1914 | Corthell | 211/33 |
| 1,124,714 | A | * | 1/1915 | Denning | 211/33 |
| 1,171,198 | A | * | 2/1916 | Hellberg | 248/223.21 |
| 1,231,635 | A | * | 7/1917 | Nelson | 211/33 |
| 1,387,765 | A | * | 8/1921 | Colonna | 211/168 |
| 1,390,372 | A | * | 9/1921 | Miller | 211/32 |
| 1,393,843 | A | * | 10/1921 | Smith | 211/32 |
| 1,782,302 | A | * | 11/1930 | Harvey | 211/32 |
| 1,837,692 | A | * | 12/1931 | Thomas | 211/32 |
| 1,926,201 | A | * | 9/1933 | Kahns | 211/32 |
| 1,965,773 | A | * | 7/1934 | Jacobs | 211/32 |
| 1,984,827 | A | * | 12/1934 | Derman | 312/4 |
| 2,025,437 | A | * | 12/1935 | Brooks | 211/32 |
| 2,094,810 | A | * | 10/1937 | Oppenheimer | 211/33 |
| 2,310,439 | A | * | 2/1943 | Johnson | 211/32 |
| D151,372 | S | * | 10/1948 | Keefer | D6/317 |
| 2,709,004 | A | * | 5/1955 | Dahlstrom | 108/20 |
| 3,740,013 | A | * | 6/1973 | Bentley et al. | 223/66 |
| 5,002,190 | A | * | 3/1991 | Moreland | 211/32 |
| 6,112,909 | A | * | 9/2000 | Moseley | 211/32 |
| 7,168,577 | B1 | * | 1/2007 | Moseley | 211/32 |
| 2006/0037923 | A1 | * | 2/2006 | Newman | 211/87.01 |

* cited by examiner

*Primary Examiner* — Jennifer E. Novosad

(57) ABSTRACT

Providing for a sports equipment organizer that can support, store, display and provide ventilation for a helmet and/or other sports apparel such as gloves, a jacket, eyewear, clothing and so on is described herein. By way of example, a mounting device can be attached to a portion of an extension arm and facilitate securing the extension arm to a mounting surface. The extension arm can extend substantially perpendicular out from the mounting surface. Additionally, a mounting arm can be attached to and supported by the extension arm, and can securely support at least one head-ware device. Furthermore the mounting arm can be of sufficient length to hold the head-ware just off of the extension arm. In accordance with particular embodiments, the mounting arm can be substantially smaller volume than an interior of the head-ware to facilitate adequate airflow and ventilation to the head-ware in between use.

20 Claims, 9 Drawing Sheets

SPORTS APPAREL ORAGNIZER

BACKGROUND

Sports equipment can often be neglected in between games or events. Trailers, bags, and other equipment suitable for porting sporting gear and apparel are not always sufficient for properly storing such gear and apparel. Additionally, it can be easy to lose track of sporting equipment if it is not transported, stored and/or maintained in a visible location. The inside of a bag or trailer or other device that can transport sports apparel does often not provide sufficient visibility to keep track of and aerate equipment.

Helmets especially can be important pieces of equipment to properly store and maintain. If not properly stored, helmets can easily scratch reducing their visual appeal, and/or have protective integrity damage reducing the helmet's safety effectiveness. In addition, straps, padding, and other helmet accessories can break and/or wear prematurely if not stored and maintained properly. Of particular concern with helmets, gloves and similar equipment worn in direct contact with the human body, is ventilation. Such equipment can accumulate sweat, chalk, deodorant and other chemicals during use at sporting events and matches that require exposure to good ventilation in order to limit odors.

Sporting equipment can also be subject to misplacement in between use. Worse still, relatives, children, pets and others can damage, scratch, move, misplace, etc. helmets and other sporting equipment. As a result, an improved mechanism for organizing equipment in between matches and events can be useful.

SUMMARY

The following presents a simplified summary of the disclosure in order to provide a basic understanding of some aspects of the full written description. This summary is not an extensive overview of the disclosure. It is not intended to identify key/critical elements of the invention or to delineate the scope of the invention. Its sole purpose is to present some concepts of the invention in a simplified form as a prelude to the more detailed description that is presented later.

Briefly described, the subject disclosure relates to a sports equipment organizer that can support, store, display and provide ventilation for a helmet and/or other sports apparel such as gloves, a jacket, eyewear, clothing and the like. A mounting device can be attached to a portion of an extension arm and secure the extension arm to a mounting surface. The extension arm can extend substantially perpendicular out from the mounting surface. Additionally, a mounting arm can be attached to and supported by the extension arm, and can securely support at least one head-ware device.

According to additional aspects of the claimed subject matter, the mounting arm can support head-ware in a manner that provides ventilation. Specifically, the mounting arm can hold the head-ware aloft and allow air to circulate in and around the head-ware. For example, the mounting arm support surface can be of a substantially smaller volume than an inside portion of the head-ware, allowing air to circulate in and out freely. As described, the claimed subject matter provides an apparatus that can store and provide ventilation to such apparel in between events and matches.

According to additional aspects of the claimed subject matter, an apparatus is provided that can organize and store sporting apparel including at least a helmet, gloves, and jacket. In addition to a mounting device, extension arm and mounting arm, the apparatus can include an attachment mechanism that extends outward from the extension arm that can secure a clothes hanger bearing at least a jacket, or gloves, or both. According to additional aspects, the attachment mechanism can extend bilaterally outward from the extension arm and support at least two clothes hangers bearing sporting apparel and/or clothing, a pair of gloves, or both.

Related aspects provide for an organizer apparatus that can securely strap and store a sporting helmet in between matches or events. The apparatus can include an extension stud or loop that protrudes out from an extension arm or mounting arm of the apparatus, enabling a chin strap of the sporting helmet to secure the helmet tightly to the organizer. As a particular example, the extension stud or loop can protrude outward from a point substantially coincident with a point where the extension arm and the mounting arm coincide. According to additional aspects, the apparatus can include a padding material, partly including silicone rubber for instance, that covers metal edges of a support surface and that softly supports the helmet. The padding material can be attached to an end of the mounting arm and/or mounting arm support surface (e.g., 2 inch by 2 inch metal plate) that contacts the helmet, providing a firm yet supple seat for the helmet.

In accordance with related aspects of the claimed subject matter, a method for making a helmet and sporting apparel organizer is provided. The method can comprise attaching a mounting bracket to a longitudinal extension arm, the mounting bracket secures the extension arm to a mounting surface and the extension arm extends outward from the mounting surface. In addition, the method can comprise attaching a mounting arm to the extension arm, the mounting arm can extend outward and upward, for instance, from the extension arm a distance sufficient to support at least one sports headware device off of the extension arm.

The following description and the annexed drawings set forth in detail certain illustrative aspects of the claimed subject matter. These aspects are indicative, however, of but a few of the various ways in which the principles of the claimed subject matter may be employed and the claimed subject matter is intended to include all such aspects and their equivalents. Other advantages and distinguishing features of the claimed subject matter will become apparent from the following detailed description of the claimed subject matter when considered in conjunction with the drawings.

DETAILED DESCRIPTION

Figure 1:
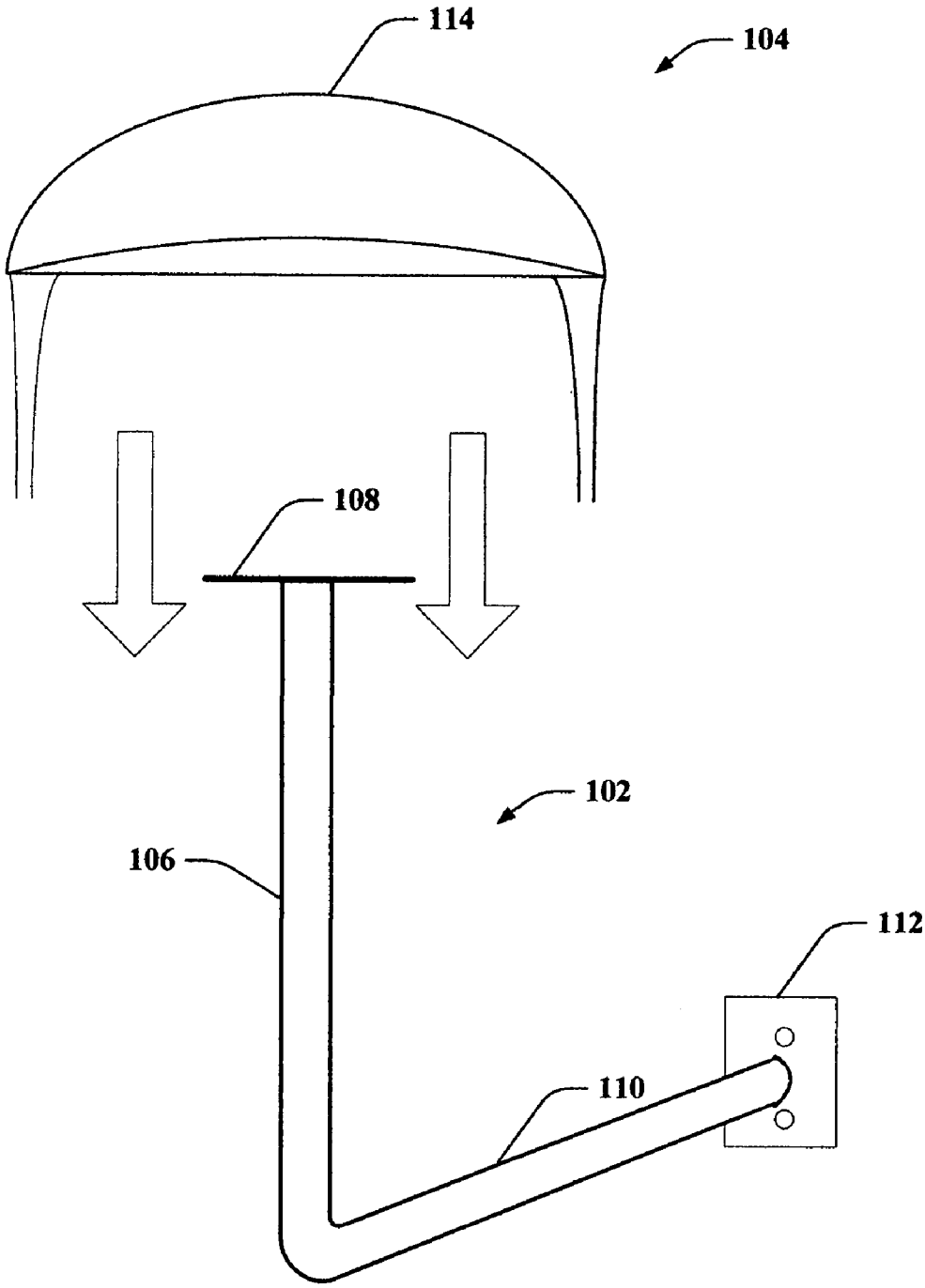
FIG. 1 illustrates an example helmet organizing apparatus in accordance with aspects of the claimed subject matter.

The claimed subject matter is now described with reference to the drawings, wherein like reference numerals are used to refer to like elements throughout. In the following description, for purposes of explanation, numerous specific details are described in order to provide a thorough understanding of the claimed subject matter. It can be evident, however, that the claimed subject matter can be practiced without one or more of these specific details. In addition, not all possible details within the scope of the subject innovation can be specifically articulated and/or depicted herein. However, such details or embodiments, known in the art or made known to one of skill in the art by way of the context provided herein, are incorporated into the subject specification. In some instances, well-known structures and devices can be shown in block diagram form in order to facilitate describing the claimed subject matter.

Furthermore, the claimed subject matter may be implemented as a method, apparatus, or article of manufacture using standard manufacturing and/or engineering techniques to produce the disclosed subject matter. Of course, those skilled in the art will recognize many modifications may be made to this configuration without departing from the scope or spirit of the claimed subject matter. In addition, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Referring now to FIG. 1 a helmet organizing apparatus 102 in accordance with aspects of the claimed subject matter is depicted. The helmet organizing apparatus 102 is depicted along with a helmet 104 in FIG. 1. Helmet 104 can be oriented as shown, and be seated upon the organizing apparatus as indicated by the downward arrows.

Apparatus 102 can include a mounting arm 106 that can support and secure at least one head-ware (e.g., helmet 104). The mounting arm can be any suitable, substantially rigid device having a longitudinal dimension sufficient to support the head-ware (104) off of a mounting surface and/or an extension object (e.g., an extension arm 108). The mounting arm can optionally have a seat 108 that can provide a surface (e.g., substantially planar surface, curved convex or concave surface, or the like) for the head-ware (104) to rest upon. For instance, the seat 108 can support the head-ware (104) at an inner crown (e.g., an inner surface of the apex 114 of the helmet) portion of such head-ware.

In addition, apparatus 102 can include an extension arm 110 that extends substantially perpendicular out from a mounting surface (not depicted), and can support the mounting arm 106. The extension arm 110 can be a substantially rigid object (e.g., a rod, bar, plank, or the like) attached to the mounting arm 106 (e.g., via welding, fasteners such as screws, nails, rivets, and the like, mounting plates, etc.) Alternatively, extension arm 110 and mounting arm 106 can comprise a single object (e.g., a rod) bent (e.g., at a 30, 45, 60, 90, 120, 135, or 150 degree angle, or other suitable angle) along a longitudinal length to form both the extension arm 110 and the mounting arm 106. According to a particular embodiment, at least one mounting arm (106) is attached in a substantially perpendicular orientation to an end of the extension arm 110. The extension arm 110 can displace the mounting arm 106 and head-ware (104) from the mounting surface, so the head-ware (104) can be supported by the mounting arm 106 without being in contact with the mounting surface (e.g., to prevent scratching or otherwise damaging/defacing the head-ware).

Apparatus 102 can also include a mounting device 112 that can attach to a portion of the extension arm 110 (e.g., an end opposite the mounting arm 106) and can secure the extension arm 110 to the mounting surface (not depicted). For example, the mounting device 112 can comprise a substantially planar and rectangular portion; the substantially planar and rectangular portion can be secured flush to a substantially planar portion of the mounting surface by one or more fasteners (e.g., screws, nails, rivets, bolts, nuts, etc.) Alternatively, the substantially planar portion of the mounting device 112 can slide into a quick release bracket-type device (e.g., having a rectangular slot of similar dimension to the substantially planar and rectangular portion of the mounting device, that can accept the mounting device as it is slid into the rectangular slot for securing; not depicted) that is secured to the mounting surface by fasteners, for instance.

As depicted, apparatus 102 can provide a secure support for at least one head-ware device, and can further provide good ventilation for such device by facilitating air flow into an inner portion of the head-ware (e.g., by having a volume of the mounting arm 106 and optionally the seat 108 substantially smaller than an inner volume of the head-ware 104). It should be appreciated that apparatus 102 can be mounted (e.g., via mounting device 106) to a wall, door, ceiling, shelf, or other suitable, relatively secure and/or rigid object, such as a bed wall of a pick-up truck, a wall of a trailer, an automobile wall, door, ceiling, or the like. As a result, apparatus 102 can provide for storage, ventilation, and care of one or more sporting head-ware devices in between use.

Figure 2:
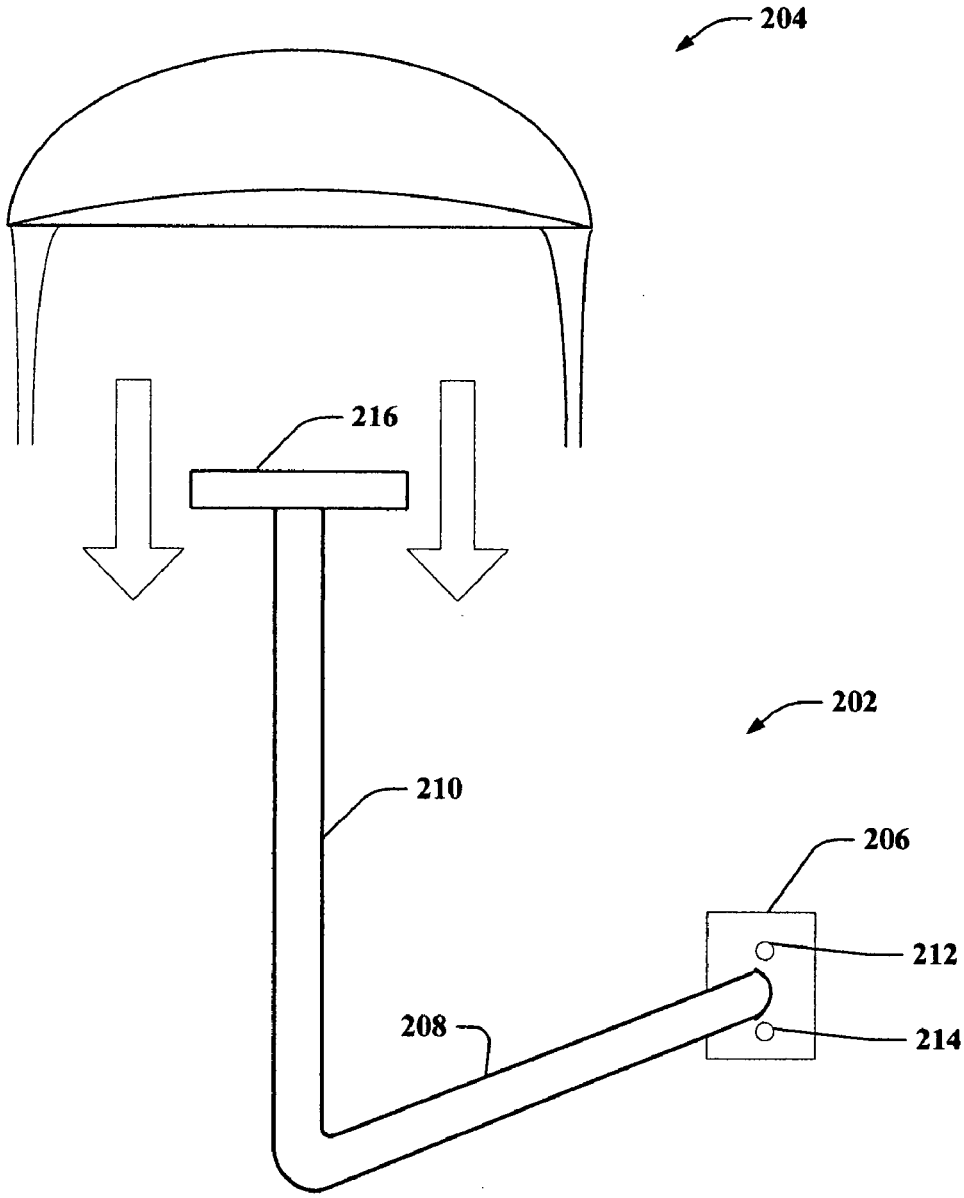
FIG. 2 depicts a sample organization apparatus in accord with one or more additional aspects.

Referring to FIG. 2, an example helmet mounting apparatus 202 is depicted in accordance with one or more aspects of the claimed subject matter. Apparatus 202 can provide a secure and supportive mount for at least one head-ware device 204. In addition, apparatus 202 can include a mounting device 206, extension arm 208, and mounting arm 210, as described herein. In addition, mounting device 204 can include one or more holes 212, 214, slots, or similar openings with which to fasten the mounting device to a mounting surface (e.g., via screws, nails, rivets, bolts, nuts, etc.)

Additionally, apparatus 202 can include a padding material 216 attached to an apex of mounting arm 210 (e.g., at an end of mounting arm 210 opposite from extension arm 208). The padding material can softly support head-ware 204, for instance, at an inner crown portion of the head-ware (e.g., an inner apex of a helmet). Padding material can be comprised at least in part of any suitable material that is relatively soft compared with mounting arm 210 and/or head-ware 204, such as foam, foam rubber, cloth, memory foam, or the like. According to a particular embodiment, padding material 216 can be comprised at least in part of rubber and/or silicone rubber. Furthermore, padding material 216 can be formed (e.g., including ridges and/or channels) so as to facilitate providing ventilation for a portion of head-ware 204 resting upon the padding material 216 (e.g., see FIG. 3, infra, for more detailed discussion). Optionally, padding material 216 can be secured to (e.g., formed around, seated around, glued to, stapled to, fastened to, or the like) a substantially rigid seat (e.g., see FIG. 1, supra, for a depiction of a mounting arm seat) that can provide additional support for a head-ware 204 device supported by the padding material 216.

In addition to the foregoing, mounting device 206, extension arm 208 and/or mounting arm 210 can be formed of a substantially rigid material such as metal, ceramic, or plastic, or combinations thereof. According to a particular embodiment, mounting device 206, extension arm 208 and/or mounting arm 210 can be formed at least in part from plastic, steel, aluminum, a steel alloy, or an aluminum alloy, or combinations thereof or of a like substantially rigid material. Additionally, mounting device 206, extension arm 208 and/or mounting arm 210 can be covered in a protective coating. For example, the protective coating can be paint or a powder coat, or like coating material, or a combination thereof.

Figure 3A:
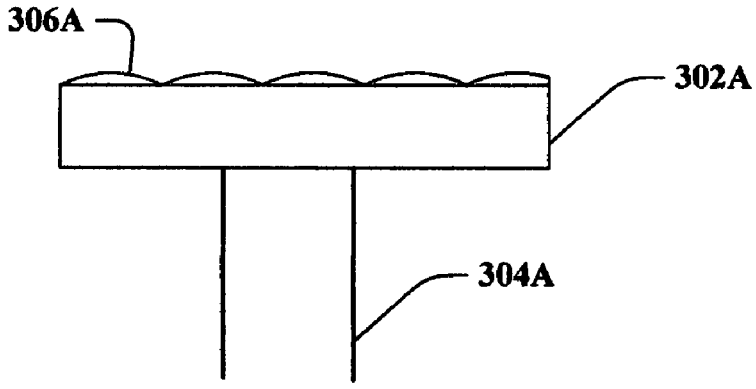
FIGS. 3A and 3B illustrate a sample helmet seat and padding for a sports apparel organizing apparatus in accordance with particular aspects.
Figure 3B:
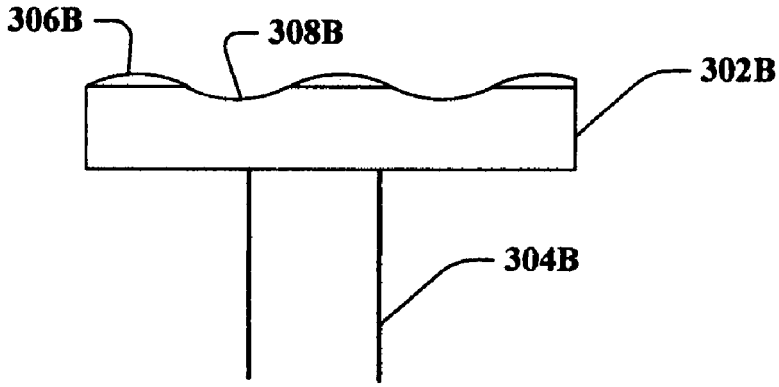

FIGS. 3A and 3B illustrate a sample helmet seat and padding for a sports apparel organizing apparatus in accordance with particular aspects of the subject disclosure. Referring initially to FIG. 3A, a padding material 302A is depicted atop an end of a mounting arm 304A of a sporting apparel organizer apparatus (not depicted). More particularly, the padding material contains ridges 306A formed into a surface of the material that can come into contact with a portion of a helmet (not depicted). As an example, an outer and/or upper surface of the padding material 302A can include one or more ridges 306A, formed of the same material as padding material 302A, or a different material that can provide support for a helmet while facilitating ventilation (e.g., plastic, cloth, a rigid material such as metal or ceramic or the like having a soft outer covering, such as cloth, foam, rubber, plastic, foam rubber, silicone rubber, or the like) for the helmet. Each ridge 306A can have a pointed or rounded shape that, alone or in combination with other ridges 306A, can hold an inner surface of a helmet off of the padding material 302A surface and allow for airflow between the helmet and the padding material 302A and between the ridges 306A themselves. As a result, the helmet can be supported by an organizer apparatus and still be exposed to ventilation.

It should be appreciated that various numbers of grooves 306B can be included with padding material 302A. In addition, the grooves 306B can be spaced apart from each other, such that an apex to apex distance from one groove 306B to a neighboring groove 306B can be larger than a width of either groove 306B. Additionally, the grooves 306B can be extruded along a dimension of a surface of the padding material, or can be 'bumps' that extend only a portion of the dimension of the surface, or combinations thereof.

Referring to FIG. 3B, an alternate or additional embodiment is depicted for facilitating airflow to a helmet (not depicted) seated upon a padding material 302B of a mounting arm 304B. The padding material 302B can have bumps 306B and channels 308B. The bumps 306B can support the helmet off of at least a portion of the padding material 302B (e.g., the channel portions), and the channels 308B can facilitate airflow and ventilation to the helmet while seated/mounted upon the padding material 302B. The bumps 306B and channels 306B can be extruded along an entire dimension of the padding material 302B (e.g., in a direction perpendicular to the plane of the figure), or can include 'bumps' (e.g., pyramid shape, spheroid shaped, cylindrical shaped, or the like) that extend only a partial distance of a dimension of the padding material 302B.

Figure 4:
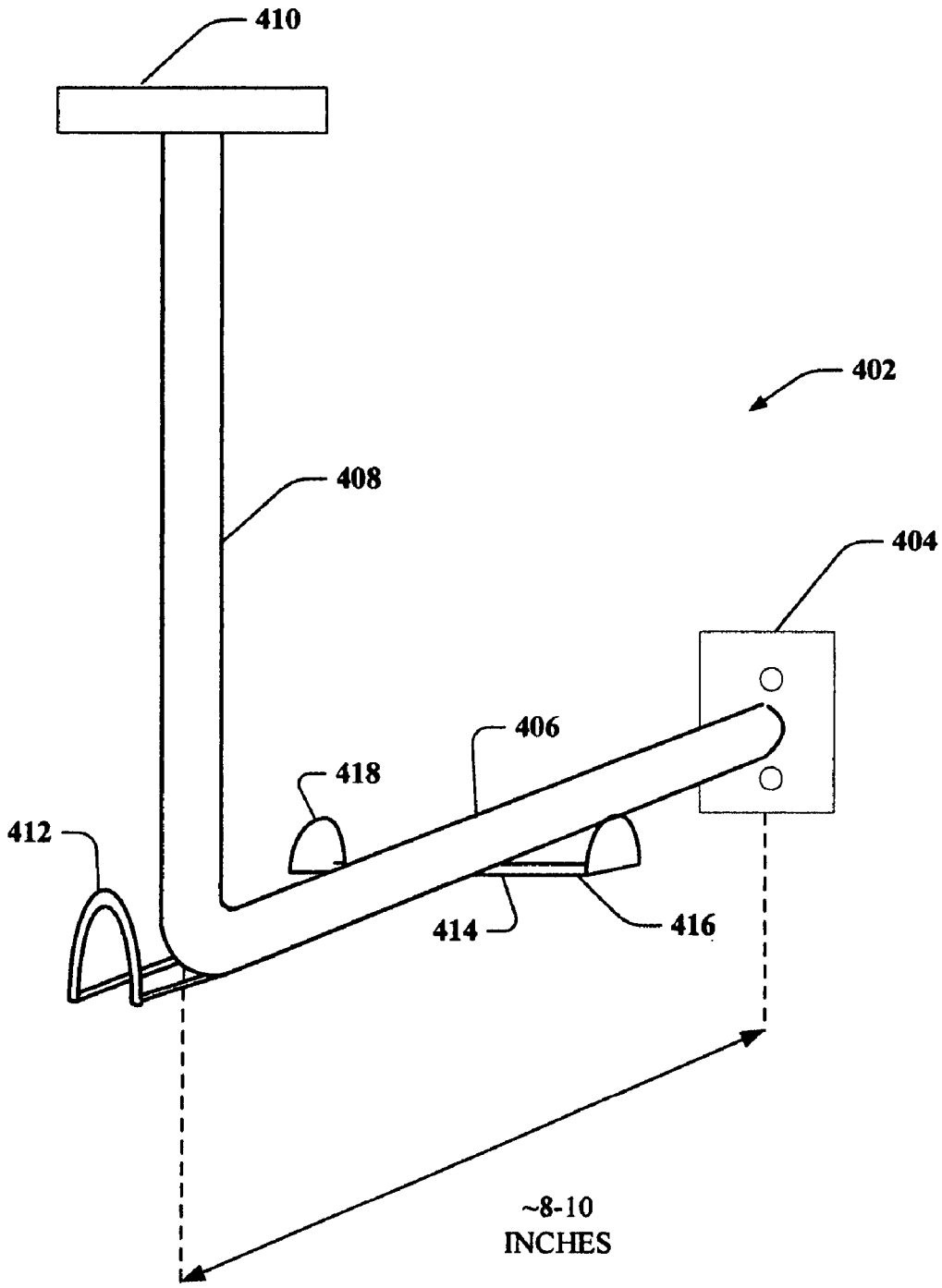
FIG. 4 depicts an example embodiment of a sporting apparel organizing apparatus.

FIG. 4 illustrates an example embodiment of a sporting apparel organizing apparatus 402 in accordance with various aspects disclosed herein. The apparatus can include a mounting device 404, extension arm 406, mounting arm 408, and padding material 410 as described herein. Additionally, apparatus 402 can include an extension stud or loop (412) that protrudes from a portion of the mounting arm 408 or the extension arm 406 at a point substantially near to a juncture between the mounting arm and the extension arm. The extension stud 412 can enable a chin strap of a head-ware device (not depicted) to attach securely to the extension arm, the mounting arm, or both. The extension stud 412 can be an extension of the mounting arm 408 or extension arm 406 past the other arm at a junction between the two arms (406, 408), or can be a separate object secured near such junction. As a particular example, the extension stud 412 can be a loop of wire, bent upward at a closed end of the loop, and attached at the open end of the loop to the extension arm 406 or the mounting arm 408 near the junction of the two arms (406, 408).

The extension stud 412 can allow a strap (e.g., a chin strap or the like) to secure a head-ware device (not depicted) to apparatus 402. For instance, the strap can be tightly secured around the extension stud 412, fastening the head-ware device to the padding material 410 and mounting arm 408. Alternately, or in addition, the strap can thread through a loop portion of the extension stud 412 and tightly secured thereto, to prevent inadvertent slipping of the helmet or the strap. As a result, one or more helmets attached to one or more mounting arms (408) (e.g., each extending outward from the extension arm 406 substantially perpendicular from each other and from the extension arm) can be secured to the apparatus 402 via by strapping the helmets to the extension stud 412. It should be appreciated that the attachment stud 412 can be comprised of and/or coated with substantially similar material as the mounting device 404, extension arm 406, and/or mounting arm 408 as described supra.

Apparatus 402 can also include an attachment mechanism 414 that can extend outward from a longitudinal dimension of the extension arm. The attachment mechanism 414 can support one or more clothing hangers bearing one or more articles of clothing, riding gloves, or a combination thereof. The attachment mechanism 414 can also support various articles of clothing and sporting apparel (e.g., shirt, pants, jacket, shoes, socks, gloves, scarf, additional helmets, or the like) by themselves or from the hangers, for instance. According to additional aspects, the attachment mechanism 414 can extend bilaterally outward from the longitudinal dimension of the extension arm 406, ending in two arms 416, 418 such that at least two clothing hangers bearing one or more articles of clothing, a pair of riding gloves, or a combination thereof, can be secured to the two arms 416, 418 of the attachment mechanism 414. As described, apparatus 402 can organize various articles of sporting equipment, including one or more helmets, a jacket, shoes/boots, gloves, pants, shirt, shoulder pads, skateboard, snowboard, and the like. In addition, the apparatus 402 can facilitate ventilation of at least the one or more helmets (not depicted) as described herein.

Figure 5:
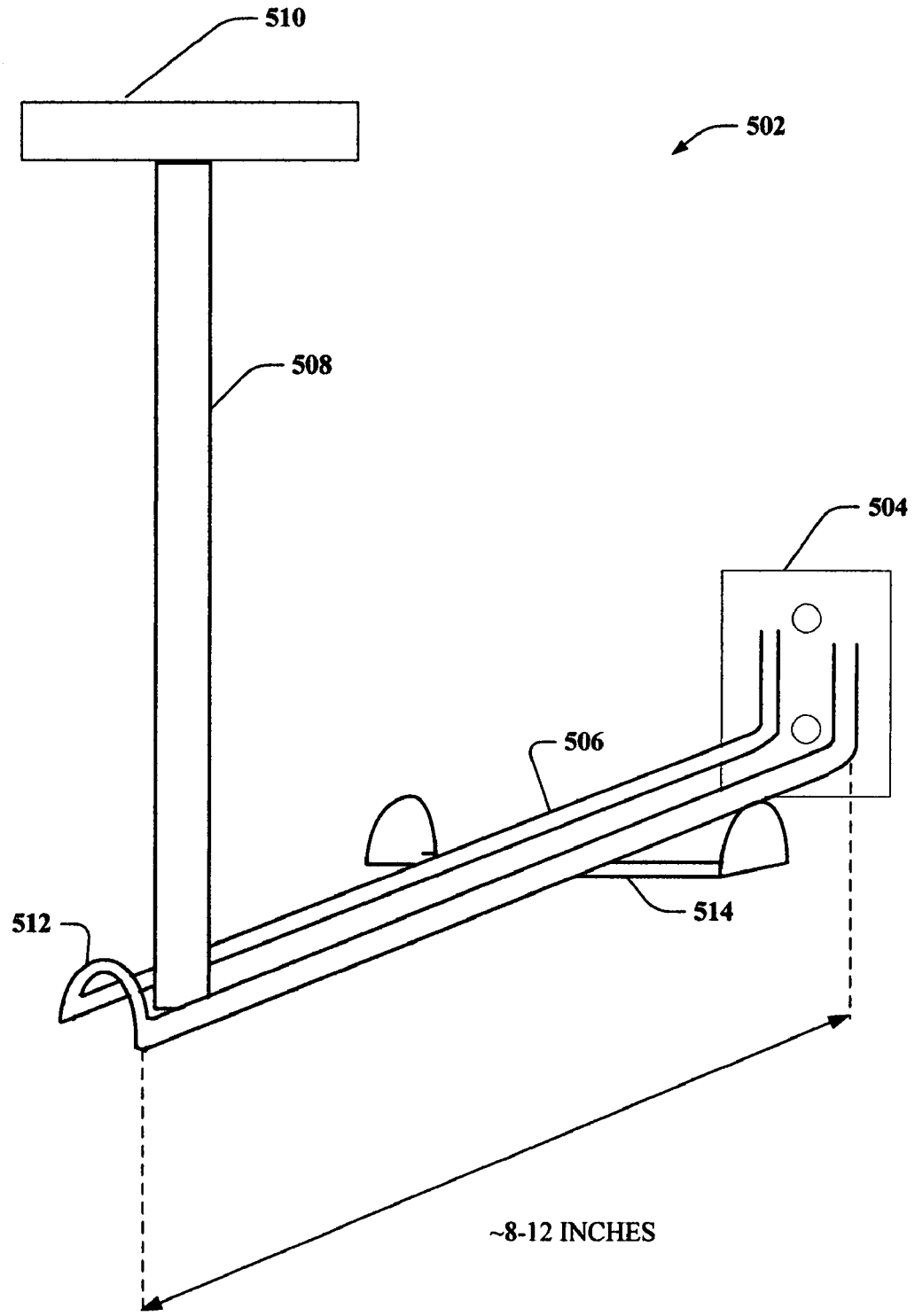
FIG. 5 depicts an example embodiment of a sporting apparel organizing apparatus in accordance with one or more additional aspects.

FIG. 5 depicts an example embodiment of a sporting apparel organizing apparatus in accordance with one or more additional aspects. Apparatus 502 can comprise a mounting device 504, extension arm 506, mounting arm 508, padding material 510 (and optionally a seat for the padding material 510), an extension stud 512, and bilateral attachment mechanism 514, as described herein. According to additional embodiments of the subject innovation, the extension arm 506 can be formed of a single piece of ⅜ inch steel wire, 22 to 26 inches long, which is formed in a substantially 1 to 1.5 inch by 10 to 14 inch loop (e.g., 1.2 inches wide by 12 inches long) by bending the wire backward to form two parallel wires substantially 0.5 inches apart. The loop can have a substantially 90 degree bend substantially 0.5 to 2 inches from both the closed end of the loop and the open end of the loop (e.g., a closed end of the loop can be bent at substantially 90 degrees 1 inch from the closed loop end, to form the extension stud 512). The substantially 90 degree bend at the closed end can form at least part of the extension stud 512. The substantially 90 degree bend at an open end (e.g., 1 inch from the open end) of the 1 inch by 12 inch loop can facilitate attaching (e.g., welding, fastening, or the like) the extension arm to the mounting device 504, as depicted. This design can offer support mechanics for the mounting arm 508 (e.g., secured vertically and substantially orthogonal to an end of the extension arm 506, for instance within 1 to 2 inches from the extension stud 412) and provide enough clearance between a mounting surface (not depicted) and the back of a helmet placed upon the padding material 510 and mounting arm 508.

In addition to the foregoing, the extension arm 506 can be formed with substantially 0.5 inch gap between the two parallel portions of the extension arm loop (506). The mounting arm 508 can be substantially 0.5 inches thick (e.g., rectangular, cylindrical or similar dimension) secured between the ⅜ inch loops, substantially 1 inch from the extension stud 512. The mounting arm 508 can be welded to both loop wires of the extension arm 506, adding structural integrity to both the extension arm 506 and the mounting arm 508.

The mounting device 504 of apparatus 502 can be substantially planar and rectangular having rectangular width of 1.5 inches and height of 3 inches, and substantially 0.25 to 0.75 inches thick. The mounting device 504 can also include two substantially 7⁄16 inch holes, near the top and bottom of the 3 inch length dimension of the rectangular plate of the mounting device 504, allowing the mounting device to be fastened to a mounting surface. In addition, the bend at the open end of the extension arm 506 can be secured to the planar portion of the mounting device 504 as described above. Furthermore, the padding material 510 can be secured to a 2 inch by 2 inch steel plate (not depicted) mounted atop the mounting arm 508. The steel plate can offer a flat, level surface for the padding material 510. Moreover, the padding material 510 can be substantially 2 inches by 2 inches, and 0.5 inches thick, having 5 raised rubber ribs on the top facilitating ventilation of a helmet seated atop the padding material 510. Additionally, the padding material 510 can clasp onto the steel plate to be secured onto the mounting arm. The padding material can facilitate soft support, grip, and ventilation for a helmet mounted to the mounting arm 508.

The bilateral attachment mechanism 514 can be a ring, disc, or loop, or the like, substantially 5 inches long with a vertical bend (e.g., substantially 90 degrees) approximately 1 inch from each end of the ring/disc/loop. These bends of attachment mechanism 514 can facilitate organization of additional sports apparel, such as clothes hangers and/or jacket, gloves, shoes, clothing, boots, shoes, additional helmets, skateboards, snowboards, shoulder pads, and the like.

As depicted, apparatus has many beneficial properties. For example, it enables a helmet and/or other sports apparel to be stored and/or transported in a secure fashion, and in a manner that facilitates ventilation of such equipment. In addition, securing the apparatus 502 in an appropriate manner (e.g., on a wall out of the reach of children, and out of plain sight) can facilitate prevention of unwanted handling, from children, visitors, or pets for instance. This apparatus 502 also can be used in an enclosed trailer for safe transport of a helmet and other equipment while traveling. The horizontal wire loop forming the extension arm 506 also offers a place to hang a jacket and other clothing, giving a well organized mechanism for hanging riding apparel as well as gloves, etc.

Figure 6:
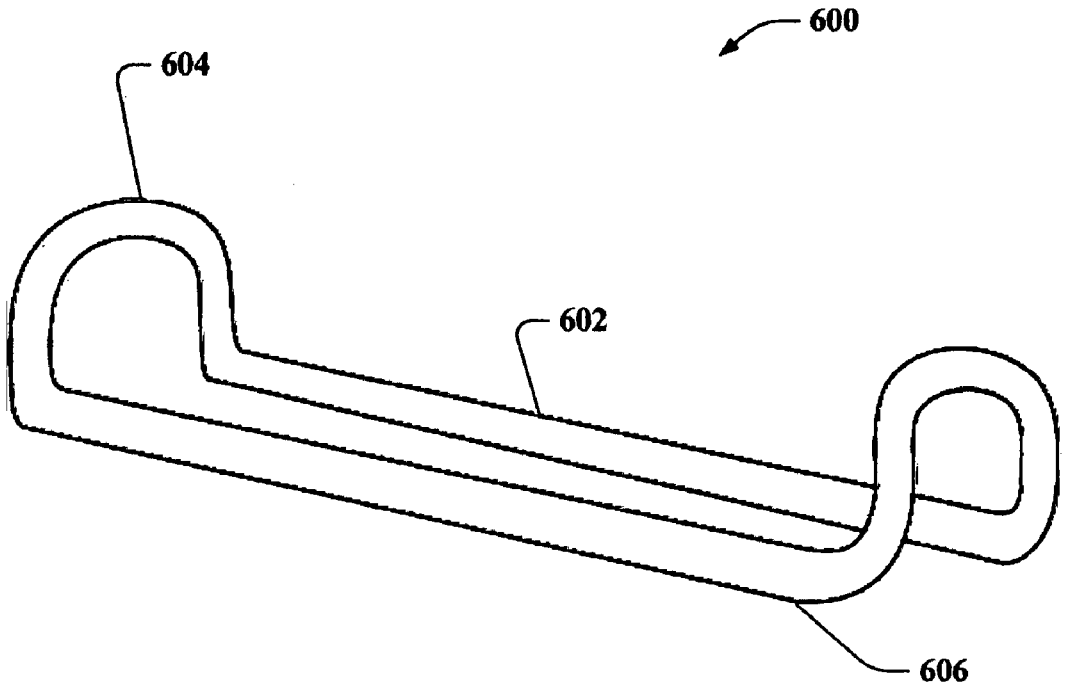
FIG. 6 illustrates an example attachment mechanism for a sports apparel organizer that can facilitate storage and/or transportation of additional equipment.

FIG. 6 illustrates an example attachment mechanism 600 for a sports apparel organizer that can facilitate storage and/or transportation of additional equipment. The attachment mechanism 600 can extend outward from a longitudinal dimension of an extension arm (e.g., as depicted at 506 of FIG. 5). Further, the attachment mechanism can support one or more articles of sports clothing (e.g., jacket, gloves, shoes, pants, etc.), one or more clothing hangers bearing one or more articles of sports clothing, riding gloves, or a combination thereof or of the like.

According to one or more aspects, attachment mechanism 600 can secure to an extension arm by various mechanisms for securing rigid materials (e.g., metals, ceramics, plastics, and so on). For instance, the attachment mechanism 600 can be welded to the extension arm. Alternatively, or in addition, the attachment mechanism can be soldered or fastened (e.g., via screws, nuts and bolts, nails, clips, staples, or the like) to the attachment arm. In accordance with further aspects, the attachment mechanism 600 can be of substantially like material as the extension arm (e.g., plastic, steel, aluminum, a steel alloy, or an aluminum alloy, or combinations thereof or of a like substantially rigid material). Additionally, the attachment mechanism 600 can be coated with a durable powder coat finish, with paint, with primer, or combinations thereof or of the like.

According to one or more particular embodiments, the attachment mechanism 600 can extend bilaterally outward from a longitudinal dimension of an extension arm, such that at least two clothing hangers bearing one or more articles of clothing, a pair of riding gloves, or a combination thereof, can be supported by the attachment mechanism 600. For instance, ends (604, 606) of the attachment mechanism 600 can be bent upward (e.g., at an angle between substantially 20 and 160 degrees, such as 90 degrees) relative to a length of the attachment mechanism that is secured to the extension arm.

As a particular example, attachment mechanism 600 can be formed of metal wire substantially ⅜ inch in diameter. The metal wire can be formed into a substantially closed loop, substantially 5 inches long. Further, ends of the closed loop can be bent substantially 90 degrees with respect to a length of the loop, at substantially 1 inch from each end, forming a 'wings' (604, 606) at the end of the attachment mechanism 600 that provide stability and security for objects suspended from the attachment mechanism 600. As described, the attachment mechanism 600, when attached to a sporting apparel organizer as described herein, can facilitate support and suspension of sporting equipment, such as clothes, jackets, gloves, shoes, skates, shoulder-pads, or one or more additional helmets, or the like, as described herein.

Figure 7:
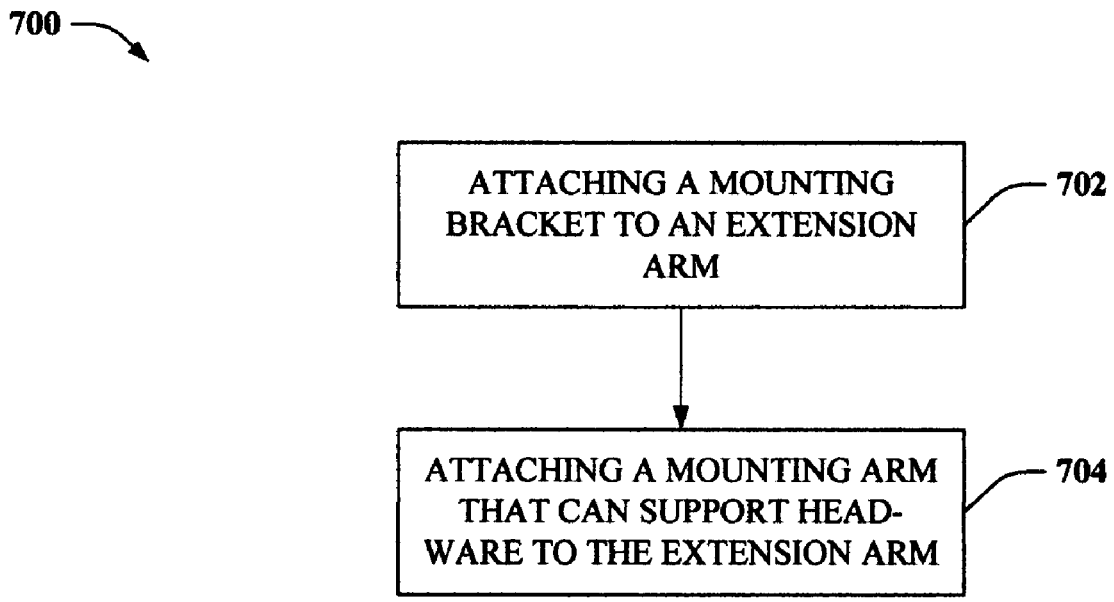
FIG. 7 depicts an example methodology for making a helmet organizer in accordance with additional aspects.
Figure 8:
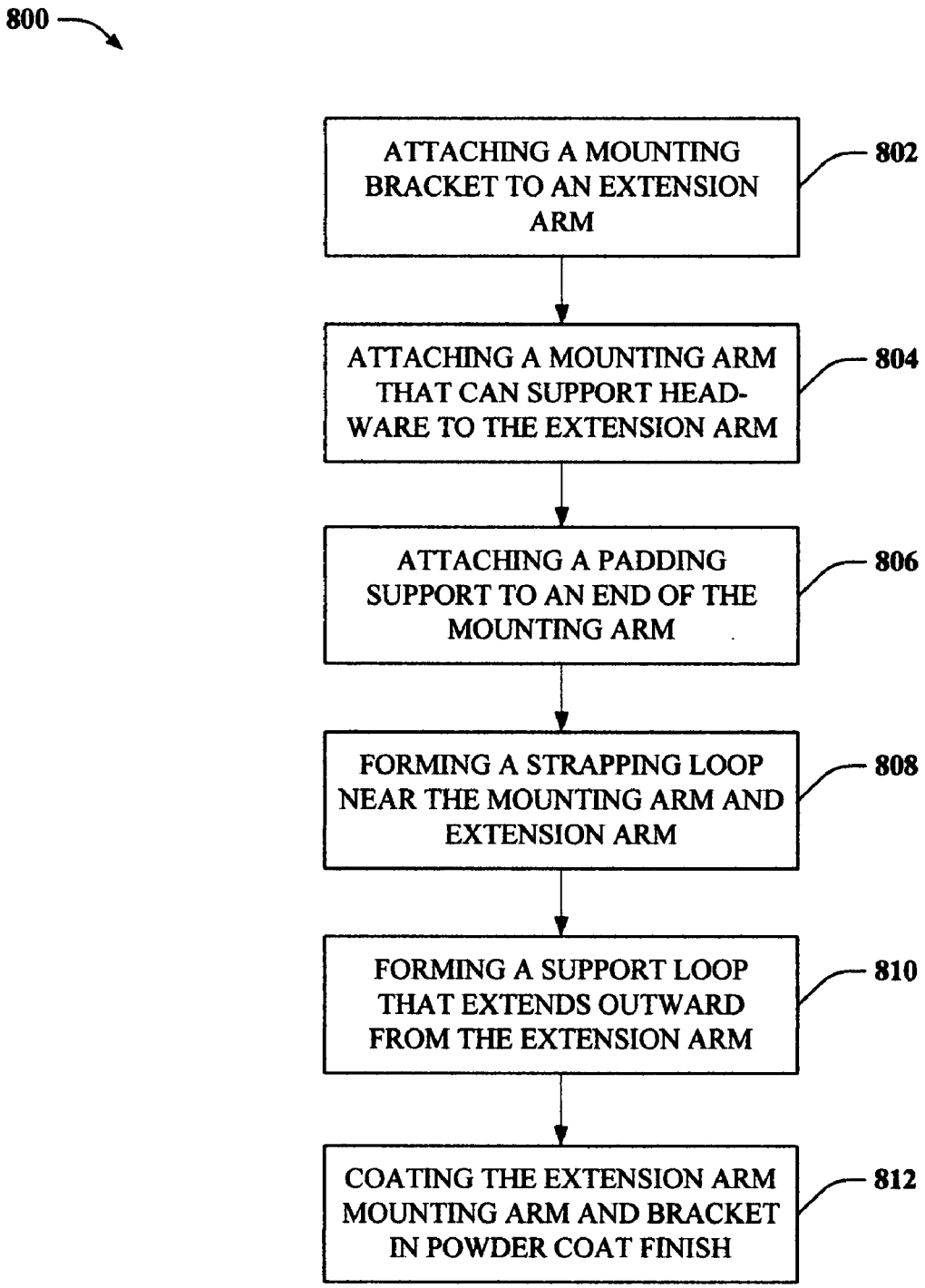
FIG. 8 illustrates a sample methodology for making a sporting apparel apparatus in accordance with further aspects.

In view of the exemplary articles and apparatus described supra, methodologies that may be implemented in accordance with the disclosed subject matter will be better appreciated with reference to the flow charts of FIGS. 7-8. While for purposes of simplicity of explanation, the methodologies are shown and described as a series of blocks, it is to be understood and appreciated that the claimed subject matter is not limited by the order of the blocks, as some blocks may occur in different orders and/or concurrently with other blocks from what is depicted and described herein. Moreover, not all illustrated blocks may be required to implement the methodologies described hereinafter. Additionally, it should be further appreciated that the methodologies disclosed hereinafter and throughout this specification are capable of being stored on an article of manufacture to facilitate transporting and transferring such methodologies to computers, computer-aided machines, such as a programmable logic controller, robotic machinery, manufacturing equipment, or the like.

FIG. 7 depicts an example methodology 700 for making a helmet organizer in accordance with additional aspects. Method 700, at 702, can facilitate attaching a mounting bracket to an extension arm, for instance, at a first end of the extension arm. Both the mounting bracket and extension arm can be comprised of substantially rigid materials, such as metal, plastic, ceramic, wood, or combinations thereof or of like materials. In addition, the extension arm can be secured to the mounting bracket by welding, soldering, fastening (e.g., via screws, nuts and bolts, nails, clips, pins, or the like), crimping, and so on. Furthermore, the mounting bracket can be configured so as to secure (e.g., via fasteners) to a substantially planar surface, such as a wall, door, ceiling, floor, or like surface.

In addition to the foregoing, the extension arm can be of a length greater than or equal to half a width of an adult helmet, child helmet or both. Alternatively, or in addition, the extension arm can be retractable and/or extendable, such that a length of the extension arm can be increased or decreased (e.g., to facilitate a shorter or longer extension out from a surface of which the mounting bracket is secured). At 704, a mounting arm sufficient to support at least one head-ware (e.g., helmet) can be attached to the extension arm. For instance, the mounting arm can extend substantially perpendicular out from the extension arm. Furthermore, the mounting arm can be of sufficient length such that the head-ware can be supported aloft at an interior apex (e.g., interior crown) portion of the head-ware while a lower rim of the head-ware is resting upon, or held above, the extension arm. In addition to the foregoing, a diameter of the mounting arm can be small with respect to an interior volume of the head-ware, to facilitate adequate air flow into and out of the interior of the head-ware. As a result, method 700 provides for making a helmet organizer that can hold, secure, and store as well as provide adequate ventilation for, at least one helmet.

FIG. 8 illustrates a sample methodology 800 for making a sporting apparel organizer in accordance with further aspects. Method 800, at reference number 802, can include attaching a mounting bracket to an extension arm (e.g., in a manner substantially similar to that described above at FIG. 7). Furthermore, at 804, a mounting arm that can support at least one head-ware can be secured to the extension arm at a first end of the mounting arm. For instance, the mounting arm can have sufficient length so as to support the head-ware at an interior apex off of, or even with, the extension arm. Moreover, the extension arm can be of sufficient length so as to separate the head-ware from a surface that the mounting bracket is secured to. Alternatively, or in addition, the extension arm, mounting arm, or both, can be adjustable at least in length, so as to provide for support/storage of various sized head-ware.

At 806, a padding support can be attached to an end of the mounting arm. Such padding support can be made of rubber, silicone rubber, or like flexible and relatively soft (e.g., as compared with the mounting arm and/or extension arm material) material. As a particular example the padding can comprise a substantially 2 inch by 2 inch portion of the relatively soft material, that mounts to and covers the edges of a substantially 2 inch by 2 inch plate formed, attached, etc., at a second end of the mounting arm. The padding material can provide a soft and flexible support for a head-ware seated thereon. In addition, the padding support can have ridges, grooves, or the like formed in a top surface (e.g., in contact with the head-ware) to facilitate air flow and ventilation to the portion of the head-ware that is resting upon the padding and/or plate.

At 808, a strapping loop can be formed near the junction of the mounting arm and the extension arm. The strapping loop can be utilized to secure a chin strap of a head-ware to the extension arm or mounting arm, as discussed above, or both. At 810, a support loop can be secured to and extend lateral to a longitudinal dimension of the extension arm. The support loop can facilitate support and storage of additional sporting apparel, such as a jacket, gloves, shoes, skates, shoulder-pads, one or more additional helmets, and the like. At 812, the extension arm, mounting arm, bracket, support loop, or mounting loop, or combinations thereof, in a powder coat finish. Such powder coat finish can provide a protective cover for such components to prevent rust, scratching, and the like, for instance. As described, method 800 can provide a mechanism for making a sporting apparel organizer for storing, securing, protecting, and ventilating a helmet and additional sporting equipment, as described herein.

Figure 9:
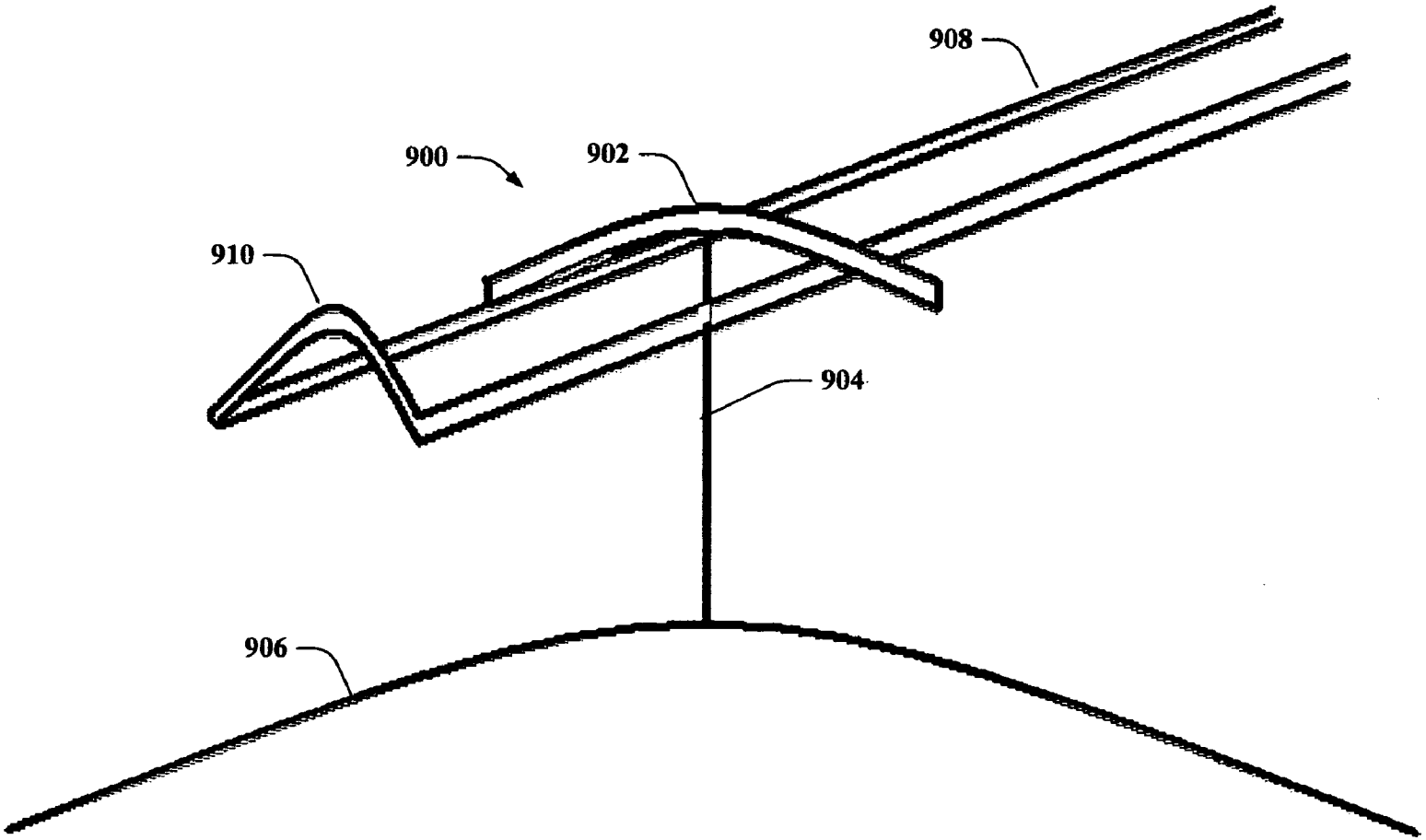
FIG. 9 depicts an example accessory item that can be utilized in combination with a sporting apparel organizer in accord with one or more embodiments set forth herein.

FIG. 9 depicts an example accessory article 900 that can be utilized in combination with a sporting apparel organizer in accord with one or more embodiments. Article 900 can include a hanger device that can mount to an extension arm 908 as described in the subject specification. The hanger device can include a hooking mechanism 902 that can slide between an opening between wire edges of the extension arm, and when rotated 90 degrees horizontally, rest upon the extension arm. Also, the extension arm 908 can have a hooked end 910 that can prevent the hanger device from inadvertently sliding off one end of the extension arm, and falling. In addition to the foregoing, the hanger device can include a vertical member 904 connecting the hooking mechanism 902 to a support frame 906. The support flame 906 can hold clothing, such as a jacket, shirt, pants, gloves, or the like. As a result, article 900 can attach to an extension arm of a sporting apparel organizer as described by the subject specification, and further support additional sporting apparel for storage in between use.

What has been described above includes examples of aspects of the claimed subject matter. It is, of course, not possible to describe every conceivable combination of components or methodologies for purposes of describing the claimed subject matter, but one of ordinary skill in the art may recognize that many further combinations and permutations of the disclosed subject matter are possible. Accordingly, the disclosed subject matter is intended to embrace all such alterations, modifications and variations that fall within the spirit and scope of the appended claims. Furthermore, to the extent that the terms "includes," "has" or "having" are used in either the detailed description or the claims, such terms are intended to be inclusive in a manner similar to the term "comprising" as "comprising" is interpreted when employed as a transitional word in a claim.

What is claimed is:

1. An apparatus that facilitates care of human apparel, sportswear or sports equipment, comprising:

a mounting device comprising a substantially planar and rectangular portion that secures the apparatus to a surface via at least two attachment points;

a mounting arm adapted to physically support a head-ware;

an extension arm comprising an elongated and substantially rigid material is in contact with and supports the mounting arm a distance away from the mounting device, the extension arm and mounting device are formed separately and fastened together;

a padding material attached to an apex of the mounting arm;

a closed loop extension stud that protrudes from the apparatus near to a juncture of the extension arm and the mounting arm; and an attachment mechanism that extends outward from a longitudinal dimension of the extension arm, is at least one inch from the mounting device and at least one inch from the mounting arm along a length dimension of the extension arm, and is adapted to support an article of apparel other than or in addition to the head-ware; wherein:

the mounting arm and the extension arm are at least one quarter inch in thickness or diameter, and the mounting device being flush with the surface at least one half inch in width.

2. The apparatus of claim 1, further comprising a mounting surface at an end of the mounting arm opposite the extension arm adapted to support the head-ware at an inner crown portion of the head-ware; wherein the padding material covers the mounting surface.

3. The apparatus of claim 1, the padding material having a substantially planar upper surface that is comprised at least in part of silicone rubber.

4. The apparatus of claim 3, the padding material further comprises at least one of:

a plurality of ridges formed at the substantially planar upper surface of the padding material adapted to support the head-ware above at least a portion of the upper surface of the padding material; or a series of adjacent bumps and channels formed at the substantially planar upper surface adapted to support the head-ware above at least the channels of the upper surface of the padding material.

5. The apparatus of claim 1, wherein the closed loop extension stud is adapted to secure the head-ware to the mounting arm upon attaching a chin strap of the headware to the closed loop extension stud.

6. The apparatus of claim 1, the attachment mechanism extends bilaterally outward from the longitudinal dimension of the extension arm.

7. The apparatus of claim 1, the substantially planar and rectangular portion having a width dimension equal to substantially one and a half inches or a thickness between substantially one quarter to three quarters of an inch.

8. The apparatus of claim 1, the extension arm comprises an elongated rod bent to form two substantially parallel portions of the elongated rod having a closed end and an open end thereof, wherein one or both of the substantially parallel portions are secured to the mounting device at the open end; and further wherein the elongated rod is at least one eighth inch in diameter.

9. The apparatus of claim 8, wherein at least one of:

the two substantially parallel portions of the elongated rod are bent substantially ninety degrees substantially halfway along a length of the parallel portions to form the mounting arm and the extension arm out of the extruded rod; or the mounting arm comprises a second elongated rod attached to the closed end of the two substantially parallel portions of the elongated rod with the attachment procedure or with a second attachment procedure.

10. The apparatus of claim 8, the two substantially parallel portions of the elongated rod are bent substantially ninety degrees between one half an inch and three inches from the open end to form a parallel mount portion of the extension arm, wherein the extension arm and the mounting device are fastened together by securing the parallel mount portion to the mounting device.

11. The apparatus of claim 8, the two substantially parallel portions are bent away from a length dimension of the extension arm near the closed end to form a closed loop extension stud.

12. The apparatus of claim 8, comprising a welding operation or one or more fasteners to fasten the extension arm to the mounting device.

13. The apparatus of claim 8, the extension arm is formed with substantially one half inch gap between the two substantially parallel portions of the elongated rod.

14. The apparatus of claim 13, the mounting arm is substantially one half an inch in thickness or smaller, and is secured between the two substantially parallel portions of the elongated rod.

15. The apparatus of claim 8, further comprising an accessory article adapted to attach to the extension arm, comprising:

a hooking mechanism that secures to the extension arm between the two substantially parallel portions of the elongated rod;

a support frame secured to the hooking mechanism and adapted to support an article of clothing; and a vertical member that secures the hooking mechanism to the support frame enabling the article of clothing to be supported by the extension arm via the hooking mechanism and the support frame.

16. The apparatus of claim 1, wherein at least one of:

the mounting arm is substantially between eight and ten inches long; or the extension arm is substantially between eight and twelve inches long.

17. The apparatus of claim 1, the mounting device, the extension arm, or the mounting arm, or a combination thereof, are comprised at least in part of steel or a steel alloy.

18. The apparatus of claim 1, the mounting device, the extension arm, or the mounting arm, or a combination thereof, are coated at least in part with a powder-coat finish.

19. The claim of 1 wherein at least one of the following:

the padding material further comprises a plurality of ridges or a series of adjacent bumps and channels formed at the substantially planar upper surface of the padding material adapted to support the head-ware above at least a portion of the upper surface of the padding material;

the extension arm comprises an elongated rod bent to form two substantially parallel portions of the elongated rod having a closed end and an open end thereof, wherein the open end is secured to the mounting device and the closed end is bent away from a longitudinal dimension of the extension arm to form the closed loop extension stud; or the apparatus further comprises an attachment mechanism that extends perpendicularly or bilaterally outward from the longitudinal dimension of the extension arm a distance of at least one inch from the mounting device and at least one inch from the mounting arm.

20. An apparatus that secures at least one human headware, comprising:

a mounting device comprising a substantially planar and rectangular portion that is at least one half inch in width, at least one inch in height, and at least one eighth inch in thickness and is formed of steel or a steel alloy, and comprises at least two fastening points for securing the apparatus to a surface;

a mounting arm adapted to physically support a head-ware, the mounting arm comprising an extruded rectangular rod substantially one half inch in width or in depth and formed of either solid steel or steel alloy, or formed of a hollow extrusion of at least one sixteenth inch thickness steel or steel alloy;

a mounting surface at an end of the mounting arm adapted to support the human headware at an inner crown portion, and covered with a padding material formed of rubber or a rubber derivative, the padding material comprising a substantially planar upper surface having either substantially parallel ridges, or substantially parallel series of extruded bumps and channels, for supporting an interior of the human headware above at least a portion of the substantially planar upper surface of the padding material; and an extension arm comprising an elongated and substantially rigid rod bent to form a closed end and an open end comprising two substantially parallel portions of the rod, wherein:

the mounting arm is secured to the extension arm near the closed end thereof;

the two substantially parallel portions of the rod are bent substantially ninety degrees at a distance from the open end of a half an inch or more to form a mounting portion of the extension arm, the mounting portion being secured to the mounting device thereby securing the extension arm to the surface;

the two substantially parallel portions are bent at least in part transverse to a length dimension of the extension arm to form a closed loop extension stud near an intersection of the mounting arm and the extension arm; and the extension arm is at least six inches in length to separate the mounting arm at least four to five inches away from the mounting device.

* * * * *